United States Patent [19]

Langlitz et al.

[11] 4,248,409

[45] Feb. 3, 1981

[54] STEEL FURNACE NOZZLE ARRANGEMENT

[75] Inventors: Karlheinz Langlitz, Mülheim; Günter Schmitz, Duisburg, both of Fed. Rep. of Germany

[73] Assignee: Mannesmann Demag A.G. Wolfgang-Reuter-Platz, Duisburg, Fed. Rep. of Germany

[21] Appl. No.: 81,464

[22] Filed: Oct. 3, 1979

[30] Foreign Application Priority Data

Oct. 16, 1978 [DE] Fed. Rep. of Germany ..... 2845004

[51] Int. Cl.[3] ..... C21B 7/16

[52] U.S. Cl. ..... 266/268

[58] Field of Search ..... 266/268

[56] References Cited

U.S. PATENT DOCUMENTS

| | | | |
|---|---|---|---|
| 3,638,932 | 2/1972 | Masella | 75/60 |
| 3,697,058 | 10/1972 | Chaikin | 75/60 |
| 3,706,549 | 12/1972 | Knuppel | 75/60 |
| 3,997,335 | 12/1976 | Kolb | 75/60 |
| 4,047,936 | 9/1977 | Chang | 75/60 |
| 4,050,681 | 9/1977 | Brotzmann | 75/60 |

*Primary Examiner*—P. D. Rosenberg

*Attorney, Agent, or Firm*—Mandeville and Schweitzer

[57] ABSTRACT

A plural nozzle arrangement is provided for introducing reactants, additives and so forth to steel manufacturing furnaces, in which a unitary "plug-in" type structure is provided with a plurality of self-contained blast pipes. The arrangement of the invention also provides means for introducing separately additives, reactants or shielding gases around the periphery of the blast pipes as a secondary means of introduction while still contained on the unitary structure. The unitary structure of the invention is so configured that exposure of the periphery of the individual blast pipes to the secondary additives may be varied for different applications.

12 Claims, 4 Drawing Figures

STEEL FURNACE NOZZLE ARRANGEMENT

BACKGROUND AND DESCRIPTION OF THE INVENTION

The invention relates to a nozzle arrangement for steel manufacturing furnaces, and particularly for steel mill converters, whose blast pipes are usually positioned especially in the base or floor plate, and penetrate the vessel case and lining. The nozzle arrangement consists of a multitude of individual blast pipes for the separate supply of powdery, gaseous reactive, additional, and/or protective agents.

Such nozzle arrangements serve the purpose of introducing fresh or live gases, such as air or technically pure oxygen; and further for introducing lime or an oxygen/lime suspension to form a slag layer. Also, the nozzles may be used to supply inert gases, such as argon or nitrogen, as well as hydrocarbon gases as protective gases for the blast pipes. The distribution of the nozzles in the furnace wall and/or in the furnace floor depends on the shape of the furnace, which, in turn, is adapted to the characteristics of the selected blast process.

German DE-Os No. 17 83 165 discloses an apparatus for feeding the blast holes in the floor of a converter under a pressure of over 3 bars with a subdivided wind accumulator arranged below the blast holes, and formed in such a way that the wind accumulator device consists of a multitude of circular manifolds in concentric arrangement. Each of the blast holes in the floor consists of a metal tube, usually copper. Each of these pipes ends in a funnel at the base and is provided with an injector. Thus, the number of the blast holes matches the number of the injectors. Such a device is not only involved, but also unsafe, since in case of disturbance of one of the injectors the blast portion of the pertinent floor area is reduced.

The present invention is based on the premise that such a great number of blast holes is not required for metallurgical reasons and is supported by the experience gained in the oxygen inflation process which operates efficiently with a single blast lance whereby rarely more than three blast holes are provided at the blast lance head. Based on this, the existence of a large number of blast holes is not considered a necessity for metallurgical reasons, and the great requirement of technical apparatus is considered a disadvantage. A further disadvantage is the difficulty in having to maintain and repair such a great number of blast holes.

The present invention provides a simpler arrangement of nozzles using a minimum of technical expenditure, especially with reference to the number of parts, as well as their maintenance, and the spare part stock. This is achieved by grouping several blast pipes together in a single device, and having spaces present between the individual blast pipes, and by encasing the group of blast pipes by means of a jacket connected to a separate material input pipe, which may be connected and disconnected. The first advantage is that operation is possible with one device only. Another advantage is the small technical expenditure, as the number of parts is considerably reduced. Accordingly, the expenditure for maintainence, and for spare part inventory drops as well. The group arrangement according to the invention, also makes it possible to distribute individual nozzle arrangements according to the invention, on the floor and/or in the walls of the steel manufacturing furnace. In addition, there is the essential advantage of being able to form new flow cross sections by means of the jacket, where, optionally, more than one medium may be applied in order to increase the endurance of the nozzle, or to influence the metallurgic process mechanically or chemically.

As a further advantage of the basic concept of the invention, provision is made for positioning the blast pipes spaced from each other in a circular or polygonal annular cross section. This allows for influencing the size and shape of the flow cross section existing between the individual blast pipes. In those instances, the blast pipes, with polygonal annular cross section, touch with cross section angles and/or with cross section sides. In this way, flow cross section of uniform shape and/or size may be utilized for additional media practically between the blast pipes.

The invention is further characterized by its use in an oxygen inflation converter with a blast lance which may be lowered from above through the converter nozzle and by its eccentric arrangement to the blast lance axis in the floor area of the converter. The invention is thus suitable for the combination of two differential steel manufacturing procedures, viz. the LD process with the so-called OBM process (QBOP process).

Another improvement of the invention is the fact that for a group of blast pipes, a material feeding pipe is provided which is concentric to a nozzle case and whose distributer chamber is sealed against an outer annular chamber, and that the jacket is connected to the annular chamber which, in turn, is connected to another material feeding pipe. This arrangement gives preference to the materials which go through the blast pipes, thus resulting in a distribution favorable to the flow, while, for example, shell or jacket gases, and the like, are brought to the peripheral areas of the blast pipes for distribution.

The special development of the nozzle arrangement of the invention consists in that the nozzle case is essentially formed by one base plate receiving the blast pipes and/or the plug-in nozzles for the pipes, and one flange plate provided with a shaft portion forming the concentric distributer chamber. Also, one case part forms, together with the shaft portion the annular chamber where the jacket is connected. A very tight connection of the jacket can be achieved by providing an opening in the base plate for the connection of the jacket. Furthermore, the invention provides, between the base plate and the shaft part of the flange plate, an interchangeable nozzle plate to be plugged onto the blast pipes.

Examples of the invention are shown in the drawings, and explained in detail as follows:

DETAILED DESCRIPTION OF THE INVENTION

Figure 1:
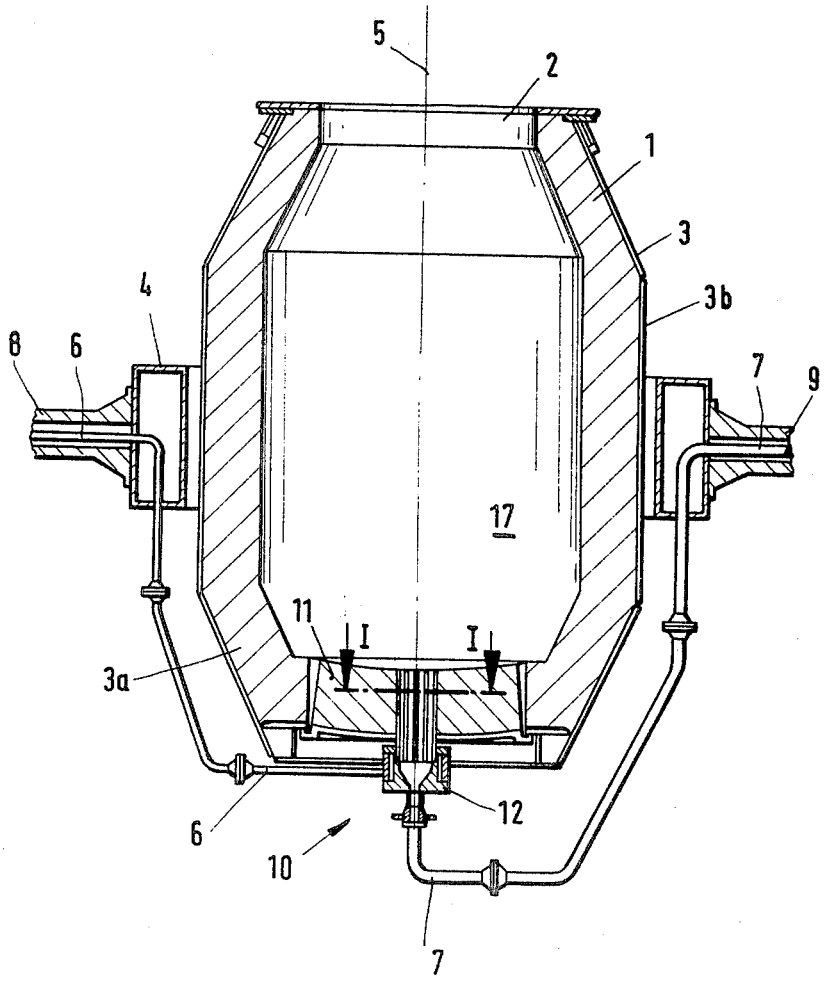
FIG. 1 is a vertical axial section through a steel mill converter illustrating the nozzle arrangement of the invention in the floor.

The converter 1 may be blasted with fresh and protective gases, as well as with additives, from above through nozzle 2, as well as through the vessel case 3. Also, it may be blasted through floor area 3*a* of vessel case 3, as well as through the wall area 3*b*, or through the annular support 4 bearing the weight of the converter in any and all tilting positions. In the case of a converter operated by means of blast lances, where the smelt is refined after the oxygen inflation process, a blast lance is present, not shown in detail, in the central axis 5, which may be lowered into the converter from above.

Figure 4:
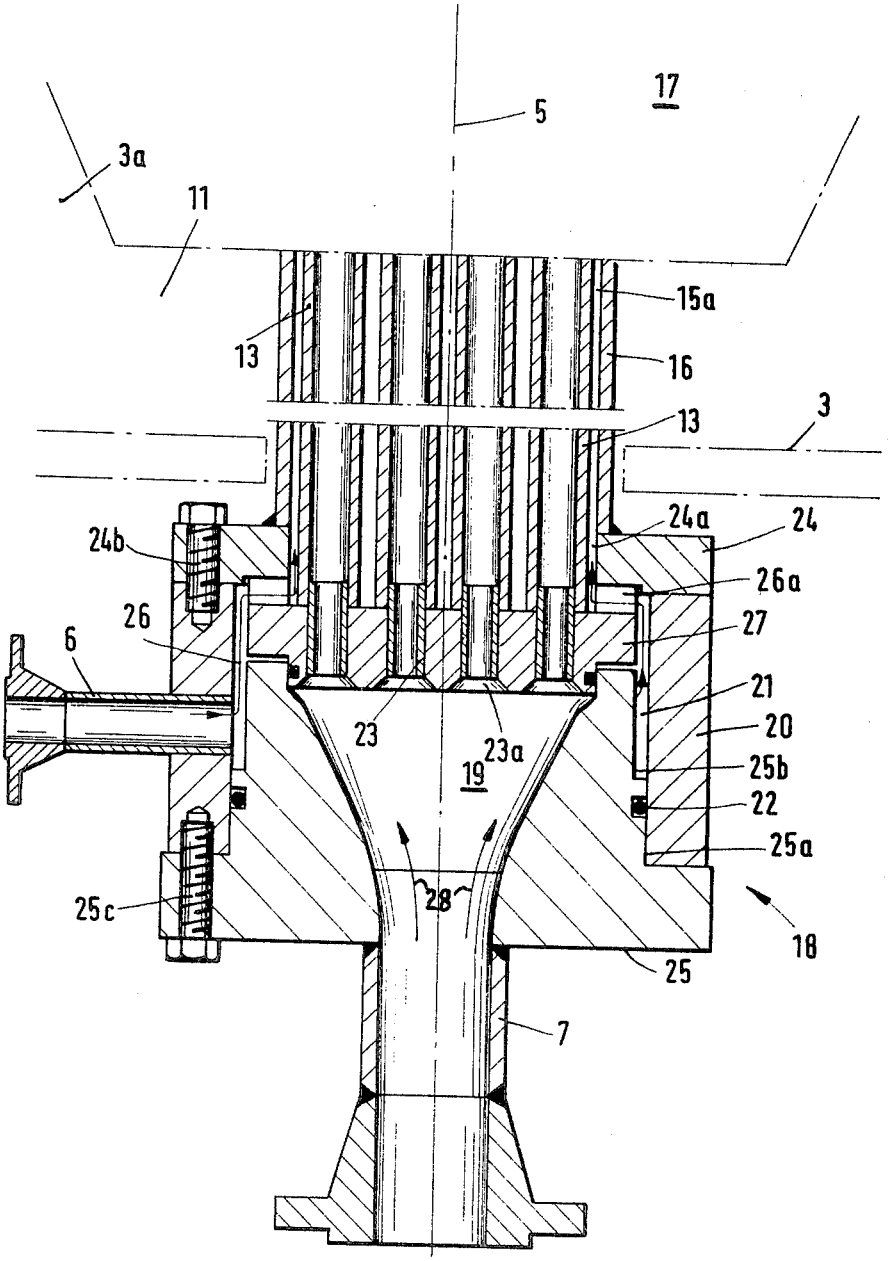
FIG. 4 is an enlarged axial sectional view illustrating the nozzle arrangement of the invention as shown in FIG. 1.

The nozzle arrangement described here may be used independently for a converter blasted from the floor according to the so-called OBM process, or in combination with the oxygen inflation process. In the example shown, material feeding pipes 6 and 7 extend through the hollow pivot pins 8, and penetrate annular support 4, and are connected to the nozzle arrangement 10. The latter is found, according to FIG. 1, in the floor plate 11 and has a distributor 12. The distributor 12 is described in detail in FIG. 4.

That part of the nozzle arrangement 10 which penetrates the floor plate 11 consists of cylindrical pipes. The blast pipes 13 (FIG. 2) are round in the embodiment shown, and only touch longitudinally at 14, leaving approximately triangular cross sectional areas 15 so that there are spaces between the outer circumferences 13*a* of the pipes 13. Areas 15, together with the longitudinal reach of blast pipes 13 form chambers 15*a* (FIG. 4), which are enclosed by jacket 16. The cross sectional chambers 15*a* may contain protective gases, such as argon or nitrogen which, due to their inert nature and/or due to their low inlet temperatures, encase the flow contained in the blast pipes 13 (oxygen, air, lime dust, and the like) at the entrance into the interior converter chamber 17, thus forming a protection against the chemical effects and against the thermal effects of the smelt in the converter.

Figure 2:
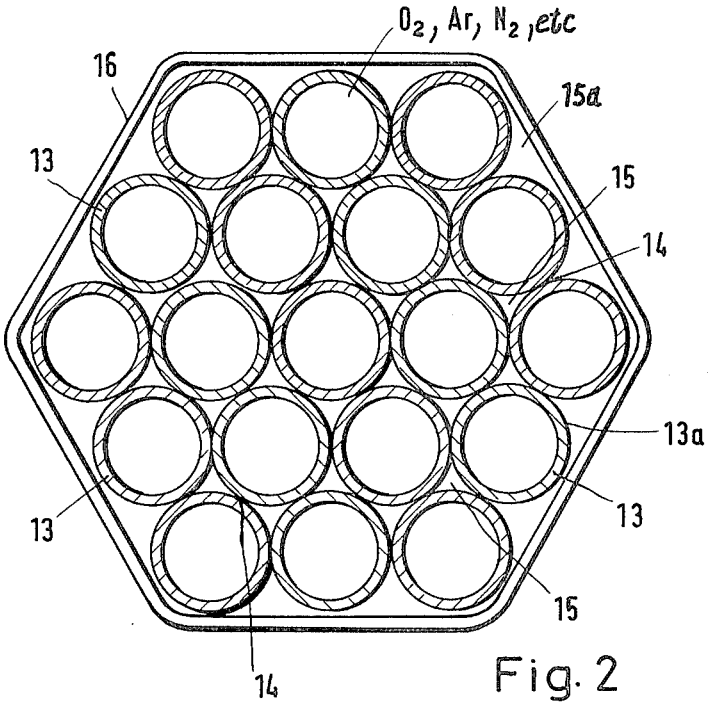
FIG. 2 is a cross sectional view along lines I—I of FIG. 1.
Figure 3:
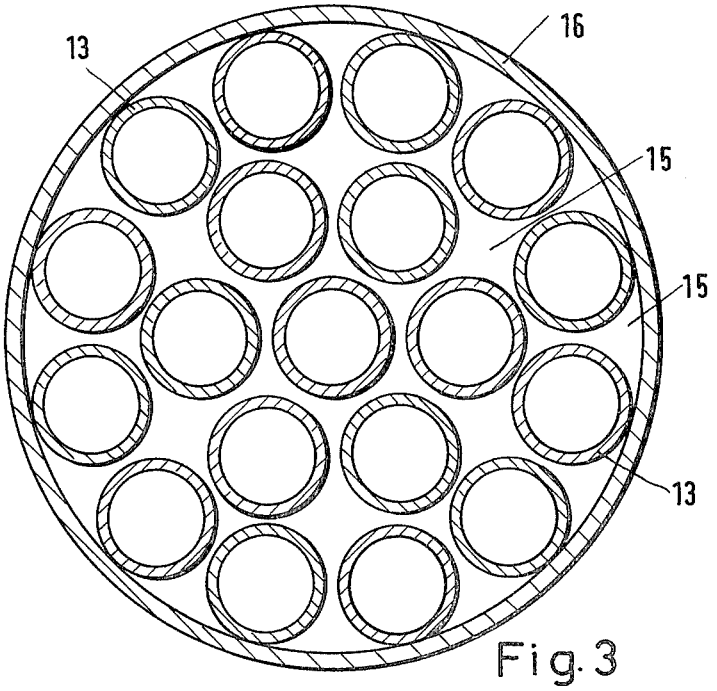
FIG. 3 is a cross sectional view similar to FIG. 2, but showing a further embodiment of the invention.

In FIG. 3, the blast pipes 13, which are of circular cross section are, in a variation of the concept of the invention, positioned further apart, which results in considerably larger cross sectional areas 15. This ability to vary the exposed surfaces of pipes 13 represents an essential component of the concept of the invention. By selecting a polygonal cross section, such as the hexagonal one of FIG. 2, cross sectional areas 15 of equal size form are created, through which, besides powdery materials, granular materials of considerable grain size may pass as well without danger of blockage. In the examples shown in FIGS. 2 and 3, the cross sectional chambers 15*a* contain the protective gases. Furthermore, the shape of the cross sectional surfaces 15 may be varied by the configuration of differential polygons and by opposing cross sectional corners and/or cross sectional sides.

The number of blast pipes 13 as shown in FIGS. 2 and 3 form one group of blast pipes. Such a group may be provided in a multiple arrangement at the converter 1, whereby individual groups run at a slant in the floor area 3*a* or parallel with the center axis 5 in the wall area 3*b*. The term "at a slant" here refers also to the ground plan of the converter 1 in the sense of a force producing a smelt flow circulating in the converter.

The nozzle case 18 (FIG. 4) shows a distributor chamber 19 in flange plate 25. Together with the case port 20 it forms an annular chamber 21 which is sealed against the outside by means of the annular packing 22. The gas arriving from the adapter pipe 7 (oxygen, argon, nitrogen, air or powdery and/or granular additives) flows via the distributor chamber 19 into the blast pipes 13 through plug-in nozzles 23 coordinated with each nozzle 13. The distributor chamber 19 diverges, in flow direction as designated by arrows 28. Then, the gaseous or powdery materials flow without any obstruction into the funnel-shaped openings of the plug-in nozzles 23*a*. Case part 20, base plate 24, nozzle plate 27, and flange plate 25 are snugly reciprocally tightened by means of screws 24*b*, 25*c*. At the shaft portion 25*a* of the flange plate 25 a recess 25*b* is provided which, together with the annular shell case part 20, forms the annular chamber 21. The jacket 16 is tightly placed against the opening 24*a*, so that the material feeding pipe 6 feeds the cooling gas or other agents not partaking in the reaction of the metallurgic process, through the annular chamber 21 in the direction of arrow 26 through ducts 26*a* and through the cross sectional chambers 15*a* into the interior converter chamber 17. The plug-in nozzles 23 are attached in an exchangeable nozzle plate 27, and simultaneously form a seal between the distributor chamber 19 and the annular chamber 21.

The invention makes a variable combination of blast pipes 13 possible with differential cross section in order to produce any desired flow form of the reactive gases and/or protective agents upon entering the interior converter chamber 17. Such forms of flow exert considerable influence on the course of the metallurgic process in the steel manufacturing furnace and accelerate and intensify the course of the process.

We claim:

1. A unitary nozzle structure for simultaneously connecting a plurality of blast pipes into a steel manufacturing furnace comprising (a) a plurality of annular blast pipes defining in their interiors primary material feeding areas, (b) a feeding pipe connecting said plurality of blast pipes and said primary material feeding areas to a first source of additives; the improvement characterized by (c) said plurality of blast pipes mounted together in parallel fashion to form a unitary bundle;

(d) a tubular jacket surrounding said bundle;

(e) the areas located between the outer peripheries of said blast pipes defining secondary material feeding areas for said furnace separate from said primary material feeding areas;

(f) a second source of additives; and (g) means connecting said second source of additives to said secondary material feeding areas.

2. The apparatus of claim 1, further characterized by (a) said blast pipes are circular or polygonal in cross section.

3. The apparatus of claim 2, further characterized by (a) said blast pipes are polygonal in cross section; and (b) the peripheries of said polygonal blast pipes touch each other;

(c) the point of contact between said blast pipes being along the adjacent side edges thereof or at angled points formed by the side edges thereof.

4. The apparatus of claim 1, further characterized by (a) said furnace is an oxygen inflation converter; and (b) the central axis of said unitary nozzle structure is parallel to the central axis of the floor plate of said furnace.

5. The apparatus of claim 1, further characterized by
(a) a nozzle case for engaging said feeding pipe;
(b) said nozzle case being concentric with said feeding pipe and said unitary nozzle structure;
(c) a distributor chamber in said nozzle case;
(d) said distributor chamber diverging from said feeding pipe to said blast pipes;
(e) said connecting means including an outer case surrounding said nozzle case; and
(f) said outer case and said nozzle case defining an outer chamber sealed from said distributor chamber and connected to said second source of additives.

6. The apparatus of claim 4, further characterized by
(a) said nozzle case includes a nozzle plate;
(b) a plurality of plug-in nozzles in said nozzle plate for engaging said blast pipes;
(c) said nozzle case includes an annular flange portion and reduced diameter annular shaft portion;
(d) said outer chamber being defined between said shaft portion and said outer case; and
(e) the lower end of said jacket connected to said outer case.

7. The apparatus of claim 6, further characterized by
(a) an annular opening in said nozzle plate for connecting said outer chamber to said secondary material feeding areas.

8. The apparatus of claim 6, further characterized by
(a) said nozzle plate of said nozzle case is selectively interchangeable.

9. The apparatus of claim 1, further characterized by
(a) said jacket is circular in cross section;
(b) said blast pipes are circular in cross section; and
(c) the outer peripheries of said blast pipes are spaced apart to define said secondary material feeding areas.

10. The apparatus of claim 1, further characterized by
(a) said jacket is hexagonal in cross section;
(b) said blast pipes are circular in cross section; and
(c) the outer peripheries of said blast pipes engage one another to form longitudinally extending secondary material feeding areas triangular in cross section.

11. The apparatus of claim 1, further characterized by
(a) said furnace is an oxygen inflation converter; and
(b) the central axis of said unitary nozzle structure is angled with respect to the central axis of said furnace.

12. A unitary nozzle structure as claimed in claim 1, wherein said secondary material feeding areas are also defined by the areas located between said jacket and said outer peripheries of said blast pipes.

* * * * *